US007910530B2

(12) United States Patent
Poirier

(10) Patent No.: US 7,910,530 B2
(45) Date of Patent: Mar. 22, 2011

(54) METHOD FOR IMPROVING THE AIR RELEASE RATE OF GTL BASE STOCK LUBRICANTS USING SYNTHETIC ESTER, AND COMPOSITION

(75) Inventor: Marc-André Poirier, Sarnia (CA)

(73) Assignee: ExxonMobil Research and Engineering Company, Annandale, NJ (US)

( * ) Notice: Subject to any disclaimer, the term of this patent is extended or adjusted under 35 U.S.C. 154(b) by 333 days.

(21) Appl. No.: 12/077,254

(22) Filed: Mar. 18, 2008

(65) Prior Publication Data

US 2008/0242568 A1 Oct. 2, 2008

Related U.S. Application Data

(60) Provisional application No. 60/921,281, filed on Mar. 30, 2007.

(51) Int. Cl.
*C07C 69/34* (2006.01)
*C10M 105/38* (2006.01)

(52) U.S. Cl. ..... 508/485; 508/165

(58) Field of Classification Search ..... 508/485, 508/465
See application file for complete search history.

(56) References Cited

U.S. PATENT DOCUMENTS

| | | | | |
|---|---|---|---|---|
| 5,698,502 | A | 12/1997 | Pafford et al. | |
| 5,962,381 | A | 10/1999 | Bovington | |
| 6,090,758 | A | 7/2000 | Pillon et al. | |
| 6,177,387 | B1 | 1/2001 | Schlosberg et al. | |
| 6,627,779 | B2 | 9/2003 | O'Rear | |
| 6,713,438 | B1 | 3/2004 | Baillargeon et al. | |
| 6,713,439 | B2 | 3/2004 | Watts | |
| 2003/0166473 | A1 * | 9/2003 | Deckman et al. | 508/192 |
| 2004/0242434 | A1 * | 12/2004 | Yagishita et al. | 508/291 |
| 2006/0131210 | A1 | 6/2006 | Rosenbaum et al. | |
| 2006/0281643 | A1 | 12/2006 | Habeeb et al. | |
| 2007/0232506 | A1 | 10/2007 | Gao et al. | |

FOREIGN PATENT DOCUMENTS

| | | | |
|---|---|---|---|
| WO | WO 03/064575 | A | 8/2003 |
| WO | WO 2008/002425 | A | 1/2008 |

* cited by examiner

*Primary Examiner* — Walter D Griffin
*Assistant Examiner* — Frank C Campanell

(57) ABSTRACT

A method for improving the air release rate of a Gas-to-Liquids (GTL) base stock and/or base oil by the addition to such base stock and/or base oil of a synthetic ester.

28 Claims, No Drawings

METHOD FOR IMPROVING THE AIR RELEASE RATE OF GTL BASE STOCK LUBRICANTS USING SYNTHETIC ESTER, AND COMPOSITION

This application claims the benefit of U.S. Provisional Application No. 60/921,281 filed Mar. 30, 2007.

BACKGROUND OF THE INVENTION

1. Field of the Invention

The present invention relates to Gas-to-Liquids (GTL) base stock(s) and/or base oils and to the improvement of the air release rate of such base stock(s) and/or base oils and of the lubricating oil compositions containing such base stock (s).

2. Related Art

Rapid air release is an important property of lubricants especially for industrial oils such as turbine oils, hydraulic oils, compressor oils and the like. The rate at which the air is released is affected by the oil viscosity, temperature (because of its effect on viscosity), system pressure, the presence of contaminants (if any), and by the additives used in the lubricant.

Lubricating oils, including hydraulic oils and crankcase oils, often are used in environments in which the oil is subject to mechanical agitation in the presence of air. As a consequence, the air becomes entrained in the oil and also forms a foam.

Foam appears on the surface of an oil as air bubbles greater than 1 mm in diameter. Air entrainment refers to the dispersion within the oil of air bubbles less than 1 mm in diameter.

Air entrainment and foaming in lubricating compositions are undesirable phenomena. For example, air entrainment reduces the bulk modulus of the fluid resulting in spongy operation and poor control of a hydraulic system's response. It can result in reduced viscosity of a lubricating composition. Both air entrainment and foaming can contribute to fluid deterioration due to enhanced oil oxidation.

Air entrainment, however, is more problematic than foaming. Foaming is typically depressed in lubricating compositions by the use of antifoamant additives. These additives expedite the breakup of a foam, but they do not inhibit air entrainment. Indeed, some antifoamants, such as silicone oils typically used in diesel and automotive crankcase oils, are known to retard air release. The rate of air release and amount of air entrainment of lubricating compositions may be determined by the test method of ASTM D 3427. Indeed, the rate of air release referred to herein has been determined by that method.

U.S. Pat. No. 6,090,758 discloses that foaming in a lubricant comprising a slack wax isomerate is effectively reduced by use of an antifoamant exhibiting a spreading coefficient of about 2 mN/m without increasing the air release time. While the specified antifoamant does not degrade the air release time, further improvements in enhancing air release characteristics are desirable.

Many modern gasoline and diesel engines are designed to use the crankcase oil to function as a hydraulic fluid to operate fuel injectors, valve train controls and the like. For these functions, low air entrainment and rapid air release are indicative of high performance lubricants. Indeed, it is anticipated that in the future the rate of air release from engine lubricants will become more critical to the proper operation of internal combustion engines as engine designs evolve and become ever more complex.

U.S. Pat. No. 6,713,438 discloses a lubricating oil composition that exhibits improved air release characteristics. The composition comprises a basestock, typically a polyalphaolefin (PAO), and two polymers of different molecular weight. One of the polymers is a viscoelastic fluid having a shear stress greater than 11 kPa such as a high VI PAO, and the other preferably is a linear block copolymer.

U.S. Pat. No. 6,627,779 relates to the use of alkylaromatics and alkylcycloparaffins derived from Fischer-Tropsch process product streams in Fischer-Tropsch lube base oils to provide improved yield as well as to provide improvements in the physical properties including additives solubility of the Fischer-Tropsch lube base oil. In an example, a 4 cSt Fischer-Tropsch base oil was combined with 5 wt % of a commercial ester (Mobil Oil Company DB-51 (Esterex A51)) to reduce the turbidity of the oil containing 1.25 wt % of a commercial additive package.

DESCRIPTION OF THE INVENTION

The present invention relates to a method for improving the air release rate of lubricating oil base stock(s) and/or base oil(s) selected from the group consisting of Gas-to-Liquids (GTL) base stock(s) and/or base oil(s) and for improving the air release rate of lubricating oil composition containing such base stock(s) and/or base oil(s), said method comprising adding to a GTL base stock and/or base oil having a kinematic viscosity at 100° C. of at least 6 $mm^2/s \pm 0.4$ $mm^2/s$ (nominal KV at 100° C. of 6 $mm^2/s$), preferably at least 6 $mm^2/s \pm 0.2$ $mm^2/s$ (nominal KV at 100° C. of 6 $mm^2/s$), more preferably at least 8 $mm^2/s \pm 0.5$ $mm^2/s$ (nominal KV at 100° C. of 8 $mm^2/s$) an effective amount of a synthetic ester. A GTL base stock and/or base oil having a kinematic viscosity at 100° C. of 6 $mm^2/s \pm 0.4$ $mm^2/s$, preferably $\pm 0.2$ $mm^2/s$ is commonly identified as a GTL-6.

The synthetic ester employed in the present invention is any mono-, di-, or tri-ester or polyol ester, preferably monocarboxylic acid ester or polyol ester, used in an amount of at least about 0.5 wt %, preferably an amount in the range 1 to 50 wt %, more preferably of from about 1 to 20 wt %, still more preferably from about 3 to 15 wt %, most preferably from about 8 to 12 wt % based on the weight of the GTL base stock and/or base oil. The synthetic esters have a kinematic viscosity at 100° C., of at least 1.5 $mm^2/s$, preferably, in the range of from about 2 $mm^2/s$ to about 6 $mm^2/s$, more preferably from about 2.5 $mm^2/s$ to about 5 $mm^2/s$.

As previously indicated the base stock and/or base oil is selected from the group consisting of Gas-to-Liquids (GTL) base stock(s) and/or base oil(s).

GTL materials are materials that are derived via one or more synthesis, combination, transformation, rearrangement, and/or degradation/deconstructive processes from gaseous carbon-containing compounds, hydrogen-containing compounds and/or elements as feedstocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons, for example waxy synthesized hydrocarbons, that are themselves derived from simpler gaseous carbon-containing compounds, hydrogen-containing compounds and/or elements as feedstocks. GTL base stock(s) and/or base oil(s) include oils boiling in the lube oil boiling range (1) separated/fractionated from synthesized GTL materials such as for example, by distillation and subsequently subjected to a final wax processing step which involves either or both of a catalytic dewaxing process, or a solvent dewaxing process, to produce lube oils of reduced/low pour point; (2) synthesized wax isomerates, comprising, for example, hydrodewaxed, or hydroisomerized/followed by cat and/or solvent dewaxed synthesized wax or waxy hydrocarbons; (3) hydrodewaxed, or hydroisomerized/followed by cat and/or solvent dewaxed Fischer-Tropsch (F-T) material (i.e., hydrocarbons, waxy hydrocarbons, waxes and possible analogous oxygenates); preferably hydrodewaxed, or hydroisomerized/followed by cat and/or solvent dewaxing dewaxed F-T waxy hydrocarbons, or hydrodewaxed or hydroisomerized/followed by cat (or solvent) dewaxing dewaxed, F-T waxes, or mixtures thereof.

GTL base stock(s) and/or base oil(s) derived from GTL materials, especially, hydrodewaxed, or hydroisomerized/cat (and/or solvent) dewaxed F-T material derived base stock(s) and/or base oil(s), are characterized typically as having kinematic viscosities (ASTM D445) at 100° C. of from about 2 $mm^2/s$ to about 50 $mm^2/s$, preferably from about 3 $mm^2/s$ to about 50 $mm^2/s$, more preferably from about 3.5 $mm^2/s$ to about 30 $mm^2/s$, as exemplified by a GTL base stock derived by the hydrodewaxing or hydroisomerization/catalytic (and/or solvent) dewaxing of F-T wax, which has a nominal kinematic viscosity of about 4 $mm^2/s$ at 100° C. and a viscosity index (ASTM D2270) of about 80 to 130 or greater. In the present invention the GTL base stock and/or base oil employed has a kinematic viscosity at 100° C. of at least 6 $mm^2/s \pm 0.4$ $mm^2/s$, preferably at least 6 $mm^2/s \pm 0.2$ $mm^2/s$, more preferably at least 8 $mm^2/s \pm 0.5$ $mm^2/s$. Preferably the wax treatment process is hydrodewaxing carried out in a process using a single hydrodewaxing catalyst. They are also characterized typically as having pour points of about −5° C. to about −40° C. or lower (ASTM D97).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, generally containing less than about 10 ppm, and more typically less than about 5 ppm of each of these elements. The sulfur and nitrogen content of GTL base stock(s) and/or base oil(s) obtained from F-T material, especially F-T wax, is essentially nil. In addition, the absence of phosphorous and aromatics make this material especially suitable for the formulation of low SAP products.

The term GTL base stock and/or base oil and/or wax isomerate base stock and/or base oil is to be understood as embracing individual fractions of such materials of wide viscosity range as recovered in the production process, mixtures of two or more of such fractions, as well as mixtures of one or two or more low viscosity fractions with one, two or more higher viscosity fractions to produce a blend wherein the blend exhibits a target kinematic viscosity.

In a preferred embodiment, the GTL material, from which the GTL base stock(s) and/or base oil(s) is/are derived is an F-T material (i.e., hydrocarbons, waxy hydrocarbons, wax).

Synthetic esters useful in the present process for increasing the air release rate of GTL base stock(s) and/or base oil(s) and of the lubricating oil formulations made employing such GTL base stock(s) and/or base oil(s) are the mono- di-, tri- or polyesters of mono- or di-carboxylic acids reacted with mono alcohols or polyols, polyols being alcohols containing more than one hydroxyl group. The mono- or di-carboxylic acids typically contain from about 4 to about 24 carbon atoms while the mono alkanol and polyols typically contain from about 1 to 18 carbon atoms.

Esters of mono- and di-basic carboxylic with mono alkanols are exemplified by one or more acids such as hexadecanoic acid, heptadecanic acid, phthalic acid, succinic acid, alkyl succinic acid, alkenyl succinic acid, maleic acid, azelaic acid, suberic acid, sebacic acid, fumaric acid, adipic acid, linoleic acid, linoleic acid dimmer, polmitic acid, stearic acid, malonic acid, alkyl malonic acid, alkenyl malonic acid, etc., with one or more of a variety of linear or branched chain alcohols such as butyl alcohol, hexyl alcohol, dodecyl alcohol, 2-ethylhexyl alcohol, n-actyl alcohol, isooctyl alcohol, decyl alcohol, isodecyl alcohol, tri-isodecyl alcohol, etc. Specific examples of these types of esters include nonyl heptanoate, dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, di-isooctyl adipate (Esterex® A32), di-tridecyladipate (Esterex® A51), ethylhexyl stearate (Stantex(® EHS), etc.

Other synthetic esters useful in this invention comprise the polyol esters. Such polyol esters are obtained by reacting one or more polyhydric alcohols, preferably hindered polyols such as the neopentyl polyols, e.g., neopentyl glycol, trimethylol ethane, trimethylol propane, 2-methyl-2 propyl-1,3-propanediol, pentaerythritol, dipentaerythritol etc., with one or more linear and/or branched chain alkanoic acids containing at least about 4 carbon atoms, preferably 5 to 30 carbon atom acids such as caprylic acid, capric acid, lauric acid, myristic acid, polmitic acid, stearic acid, arachic acid, behenic acid, octanoic acid, isooctanoic acid, nanoic acid, decanoic acid, dodecanoic acid, oleic acid and mixtures thereof.

The polyol esters may include polyol esters having unconverted hydroxyl groups. Those polyol esters having unconverted hydroxyl groups are known as high hydroxyl polyol esters. Such high hydroxyl polyol esters contain from 2 to 50% unconverted hydroxyl groups, preferably 5 to 35% unconverted hydroxyl groups based on the total amount of hydroxyl groups in the quantity of polyol employed. See WO99/36387; U.S. Pat. Nos. 5,744,434; 5,698,502; WO96/28525.

Preferred esters are mono-esters, and polyol esters of neopentyl polyols, preferably polyol esters of neopentyl glycol, trimethylol ethane, trimethylol propane (TMP), 2-methyl-2-propyl-1,3-propanediol, pentaerythritol, dipentaerylthritol and mixtures thereof reacted with linear and/or branched 5 to 30 carbon atom alkanoic acids.

Esters of choice are di-isooctyl adepate, di-tridecyladipate, ethylhexyl strearate, TMP ester $C_8$-$C_{10}$ and mixtures thereof, preferably ethylhexyl stearate, TMP ester $C_8$-$C_{10}$ and mixtures thereof.

The one or more synthetic ester(s) is (are) used in a total amount of at least about 0.5 wt %, preferably an amount ranging from about 1.0 wt % to about 50 wt %, more preferably about 1 wt % to about 20 wt % still more preferably about 3 to 15 wt %, most preferably about 8 to 12 wt % based on the weight of the GTL base stock and/or base oil. The ester has a kinematic viscosity at 100° C. of at least 1.5 $mm^2/s$, preferably in the range of from about 2 $mm^2/s$ to about 6 $mm^2/s$, more preferably from about 2.5 $mm^2/s$ to about 5 $mm^2/s$. The presence of the ester in the GTL of at least nominal 6 $mm^2/s$ kinematic viscosity increases the air release rate of the GTL base stock and/or base oil, preferably by at least about 35% compared to the air release rate of the GTL base stock and/or base oil without the ester present.

The GTL plus ester combination base oil can be used in further combination with a co-base stock such as poly alpha olefin and/or highly saturated base oil having a saturates content of greater than 99 wt %, a viscosity index (VI) greater than 120 and a sulfur content of less than 0.03 wt %, i.e., an American Petroleum Institute (API) Group III base stock, and/or a hydrodewaxed or hydroisomerized conventional catalytic (or solvent) dewaxed wax base stock and/or base oil wherein such base stock and/or base oil is derived from natural wax (e.g., slack wax recovered from the solvent dewaxing of petroleum oil), from other non synthetic waxy feeds, from mineral and/or non-mineral oil waxy feeds such as gas oils, waxy fuels hydrocracker bottoms, waxy raffinate, waxy hydrocrackate, waxy thermal crackate, waxy oils derived from coal liquefaction, shale oil or tar sands, etc., but PAO and API Group III base stocks are preferred if a co-basestock is used at all.

When the GTL plus ester combination base oil is used in further combination with the co-base stocks recited above the co-base stock has a kinematic viscosity @100° C. of about 3 to 25 $mm^2/s$, preferably about 3 to 20 $mm^2/s$, more preferably 3 to 14 $mm^2/s$, the GTL plus ester combination constituting about 20 to 80 wt %, preferably about 40 to 60 wt %, more preferably about 45 to 55 wt % of any such mixture.

Other base stocks which can be present as co-base stocks include API Group I or Group II base stocks and alkylated naphthalene having kinematic viscosities at 100° C. in the range of about 3 to 25 $mm^2/s$, preferable about 3 to 20 $mm^2/s$, more preferably about 30 to 14 $mm^2/s$, the amount of such co-base stock employed can range up to about 10 wt % of the total weight of the base oil.

API Group I base stocks generally have a viscosity index of between about 80 to 120 and contain greater than abut 0.03% sulfur and less than about 90% saturates. API Group II base stocks generally have a viscosity index of between about 80 to 120, and contain less than or equal to about 0.03% sulfur and greater than or equal to about 90% saturates. API Group III stock generally has a viscosity index greater than about 120 and contains less than or equal to about 0.03% sulfur and greater than about 90% saturates.

Polyalpha olefins are categorized as API Group IV base stocks while alkylated naphthalenes are categorized as API Group V base stocks.

Table A summarizes properties of each of these five groups.

TABLE A

API Base Stock Properties

| | Saturates | Sulfur | Viscosity Index |
|---|---|---|---|
| Group I | <90% and/or | >0.03% and | ≧80 and <120 |
| Group II | ≧90% and | ≦0.03% and | ≧80 and <120 |
| Group III | ≧90% and | ≦0.03% and | ≧120 |
| Group IV | Polyalphaolefins (PAO) | | |
| Group Vs | All other base oil stocks not included in Groups I, II, III, or IV | | |

The PAO's are typically comprised of relatively low molecular weight hydrogenated polymers or oligomers of alphaolefins which include, but are not limited to, about $C_2$ to about $C_{32}$ alphaolefins with about $C_8$ to about $C_{16}$ alphaolefins, such as 1-octene, 1-decene, 1-dodecene and the like, being preferred. The preferred polyalphaolefins are poly-1-octene, poly-1-decene and poly-1-dodecene and mixtures thereof and mixed olefin-derived polyolefins. However, the dimers of higher olefins in the range of about $C_{14}$ to $C_{18}$ may be used to provide low viscosity base stocks of acceptably low volatility. Depending on the viscosity grade and the starting oligomer, the PAO's may be predominantly trimers and tetramers of the starting olefins, with minor amounts of the higher oligomers, having a viscosity range previously recited above.

Descriptions of PAO synthesis are found in U.S. Pat. Nos. 3,742,082; 3,769,363; 3,876,720; 4,239,930; 4,367,352; 4,413,156; 4,434,408; 4,910,355; 4,956,122; 5,068,487; 4,149,178; 3,382,291. The dimers of the $C_{14}$ to $C_{18}$ olefins are described in U.S. Pat. No. 4,218,330. PAO's derived from $C_8$, $C_{10}$, $C_{12}$, $C_{14}$ olefins or mixtures thereof may be utilized as co-base stock. See U.S. Pat. Nos. 4,956,122; 4,827,064; and 4,827,073

Lubricating oil composition employing the GTL plus synthetic ester combination of improved air release rate can further, optionally contain one or more performance enhancing additives comprising anti-wear agent, anti-oxidant, viscosity modifier, viscosity index improvers, detergents, dispersants, anti-foamants, pour-point depressants, dyes, extreme pressure additives, anti-seizure agents, wax modifier, seal compatibility agents, friction modifiers, lubricity agents, anti-staining agents, chromophoric agents, demulsifiers, corrosion inhibitors etc.

For a review of many commonly used additives see Klamann in "Lubricants and Related Products, Verlag Chemie, Deerfield Beach, Fla.; ISBN 0-89573-177-0, which also gives a good discussion of a number of the lubricant additives identified below. Reference is also made to "Lubricant Additives" by M. W. Ranney, published by Noyes Data Corporation of Parkridge, N.J. (1978).

Antiwear and EP Additives

Lubricating oils require the presence of antiwear and/or extreme pressure (EP) additives in order to provide adequate antiwear protection. Increasingly specifications for oil performance have exhibited a trend for improved antiwear properties of the oil. Antiwear and extreme EP additives perform this role by reducing friction and wear of metal parts.

While there are many different types of antiwear additives, for several decades the principal antiwear additive for internal combustion engine crankcase oils is a metal alkylthiophosphate and more particularly a metal dialkyldithiophosphate in which the primary metal constituent is zinc, or zinc dialkyldithiophosphate (ZDDP). ZDDP compounds generally are of the formula $Zn[SP(S)(OR^1)(OR^2)]_2$ where $R^1$ and $R^2$ are $C_1$-$C_{18}$ alkyl groups, preferably $C_2$-$C_{12}$ alkyl groups. These alkyl groups may be straight chain or branched. The ZDDP is typically used in amounts of from about 0.4 to 1.4 wt % of the total lube oil composition, although more or less can often be used advantageously.

However, it is found that the phosphorus from these additives has a deleterious effect on the catalyst in catalytic converters and also on oxygen sensors in automobiles when the formulations are used as engine oils. One way to minimize this effect is to replace some or all of the ZDDP with phosphorus-free antiwear additives.

A variety of non-phosphorous additives are also used as antiwear additives. Sulfurized olefins are useful as antiwear and EP additives. Sulfur-containing olefins can be prepared by sulfurization or various organic materials including aliphatic, arylaliphatic or alicyclic olefinic hydrocarbons containing from about 3 to 30 carbon atoms, preferably 3-20 carbon atoms. The olefinic compounds contain at least one non-aromatic double bond. Such compounds are defined by the formula $$R^3R^4C{=}CR^5R^6$$

where each of $R^3$-$R^6$ are independently hydrogen or a hydrocarbon radical. Preferred hydrocarbon radicals are alkyl or alkenyl radicals. Any two of $R^3$-$R^6$ may be connected so as to form a cyclic ring. Additional information concerning sulfurized olefins and their preparation can be found in U.S. Pat. No. 4,941,984.

The use of polysulfides of thiophosphorus acids and thiophosphorus acid esters as lubricant additives is disclosed in U.S. Pat. Nos. 2,443,264; 2,471,115; 2,526,497; and 2,591,577. Addition of phosphorothionyl disulfides as an antiwear, antioxidant, and EP additive is disclosed in U.S. Pat. No. 3,770,854. Use of alkylthiocarbamoyl compounds (bis(dibutyl)thiocarbamoyl, for example) in combination with a molybdenum compound (oxymolybdenum diisopropylphosphorodithioate sulfide, for example) and a phosphorous ester (dibutyl hydrogen phosphite, for example) as antiwear additives in lubricants is disclosed in U.S. Pat. Nos. 4,501,678. U.S. Pat. No. 4,758,362 discloses use of a carbamate additive to provide improved antiwear and extreme pressure properties. The use of thiocarbamate as an antiwear additive is disclosed in U.S. Pat. No. 5,693,598. Thiocarbamate/molybdenum complexes such as moly-sulfur alkyl dithiocarbamate trimer complex ($R{=}C_8$-$C_{18}$ alkyl) are also useful antiwear agents. The use or addition of such materials should be kept to a minimum if the object is to produce low SAP formulations.

Esters of glycerol may be used as antiwear agents. For example, mono-, di, and tri-oleates, mono-palmitates and mono-myristates may be used.

ZDDP is combined with other compositions that provide antiwear properties. U.S. Pat. No. 5,034,141 discloses that a combination of a thiodixanthogen compound (octylthiodixanthogen, for example) and a metal thiophosphate (ZDDP, for example) can improve antiwear properties. U.S. Pat. No. 5,034,142 discloses that use of a metal alkyoxyalkylxanthate (nickel ethoxyethylxanthate, for example) and a dixanthogen (diethoxyethyl dixanthogen, for example) in combination with ZDDP improves antiwear properties.

Preferred antiwear additives include phosphorus and sulfur compounds such as zinc dithiophosphates and/or sulfur, nitrogen, boron, molybdenum phosphorodithioates, molybdenum dithiocarbamates and various organomolybdenum derivatives including heterocyclics, for example dimercaptothiadiazoles, mercaptobenzothiadiazoles, triazines, and the like, alicyclics, amines, alcohols, esters, diols, triols, fatty amides and the like can also be used. Such additives may be used in an amount of about 0.01 to 6 wt %, preferably about 0.01 to 4 wt %. ZDDP-like compounds provide limited hydroperoxide decomposition capability, significantly below that exhibited by compounds disclosed and claimed in this patent and can therefore be eliminated from the formulation or, if retained, kept at a minimal concentration to facilitate production of low SAP formulations.

Viscosity Index Improvers

Viscosity index improvers (also known as VI improvers, viscosity modifiers, and viscosity improvers) provide lubricants with high and low temperature operability. These additives impart shear stability at elevated temperatures and acceptable viscosity at low temperatures.

Suitable viscosity index improvers include high molecular weight hydrocarbons, polyesters and viscosity index improver dispersants that function as both a viscosity index improver and a dispersant. Typical molecular weights of these polymers are between about 10,000 to 1,000,000, more typically about 20,000 to 500,000, and even more typically between about 50,000 and 200,000.

Examples of suitable viscosity index improvers are polymers and copolymers of methacrylate, butadiene, olefins, or alkylated styrenes. Polyisobutylene is a commonly used viscosity index improver. Another suitable viscosity index improver is polymethacrylate (copolymers of various chain length alkyl methacrylates, for example), some formulations of which also serve as pour point depressants. Other suitable viscosity index improvers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

Viscosity index improvers may be used in an amount of about 0.01 to 8 wt %, preferably about 0.01 to 4 wt %.

Antioxidants

Antioxidants retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in Lubricants and Related Products, op cite, and U.S. Pat. Nos. 4,798,684 and 5,084,197, for example.

Useful antioxidants include hindered phenols. These phenolic antioxidants may be ashless (metal-free) phenolic compounds or neutral or basic metal salts of certain phenolic compounds. Typical phenolic antioxidant compounds are the hindered phenolics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_6$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include for example hindered 2,6-di-alkyl-phenolic proprionic ester derivatives. Bis-phenolic antioxidants may also be advantageously used in combination with the instant invention. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include for example 4,4'-bis(2,6-di-t-butyl phenol) and 4,4'-methylene-bis(2,6-di-t-butyl phenol).

Non-phenolic oxidation inhibitors which may be used include aromatic amine antioxidants and these may be used either as such or in combination with phenolics. Typical examples of non-phenolic antioxidants include: alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to about 20 carbon atoms, and preferably contains from about 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present invention include: p,p'-dioctyldiphenylamine; t-octylphenyl-alpha-naphthylamine; phenyl-alphanaphthylamine; and p-octylphenyl-alpha-naphthylamine.

Sulfurized alkyl phenols and alkali or alkaline earth metal salts thereof also are useful antioxidants.

Another class of antioxidant used in lubricating oil compositions is oil-soluble copper compounds. Any oil-soluble suitable copper compound may be blended into the lubricating oil. Examples of suitable copper antioxidants include copper dihydrocarbyl thio or dithio-phosphates and copper salts of carboxylic acid (naturally occurring or synthetic). Other suitable copper salts include copper dithiacarbamates, sulphonates, phenates, and acetylacetonates. Basic, neutral, or acidic copper Cu(I) and or Cu(II) salts derived from alkenyl succinic acids or anhydrides are know to be particularly useful.

Preferred antioxidants include hindered phenols, arylamines. These antioxidants may be used individually by type or in combination with one another. Such additives may be used in an amount of about 0.01 to 5 wt %, preferably about 0.01 to 1.5 wt %, more preferably zero to less than 1.5 wt %, most preferably zero.

Detergents

Detergents are commonly used in lubricating compositions. A typical detergent is an anionic material that contains a long chain hydrophobic portion of the molecule and a smaller anionic or oleophobic hydrophilic portion of the molecule. The anionic portion of the detergent is typically derived from an organic acid such as a sulfur acid, carboxylic acid, phosphorous acid, phenol, or mixtures thereof. The counterion is typically an alkaline earth or alkali metal.

Salts that contain a substantially stochiometric amount of the metal are described as neutral salts and have a total base number (TBN, as measured by ASTM D2896) of from 0 to 80. Many compositions are overbased, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased.

It is desirable for at least some detergent to be overbased. Overbased detergents help neutralize acidic impurities produced by the combustion process and become entrapped in the oil. Typically, the overbased material has a ratio of metallic ion to anionic portion of the detergent of about 1.05:1 to 50:1 on an equivalent basis. More preferably, the ratio is from about 4:1 to about 25:1. The resulting detergent is an overbased detergent that will typically have a TBN of about 150 or higher, often about 250 to 450 or more. Preferably, the overbasing cation is sodium, calcium, or magnesium. A mixture of detergents of differing TBN can be used in the present invention.

Preferred detergents include the alkali or alkaline earth metal salts of sulfonates, phenates, carboxylates, phosphates, and salicylates.

Sulfonates may be prepared from sulfonic acids that are typically obtained by sulfonation of alkyl substituted aromatic hydrocarbons. Hydrocarbon examples include those obtained by alkylating benzene, toluene, xylene, naphthalene, biphenyl and their halogenated derivatives (chlorobenzene, chlorotoluene, and chloronaphthalene, for example). The aikylating agents typically have about 3 to 70 carbon atoms. The alkaryl sulfonates typically contain about 9 to about 80 carbon or more carbon atoms, more typically from about 16 to 60 carbon atoms.

Klamann in "Lubricants and Related Products", op cit discloses a number of overbased metal salts of various sulfonic acids which are useful as detergents and dispersants in lubricants. The book entitled "Lubricant Additives", C. V. Smallheer and R. K. Smith, published by the Lezius-Hiles Co. of Cleveland, Ohio (1967), similarly discloses a number of overbased sulfonates that are useful as dispersants/detergents.

Alkaline earth phenates are another useful class of detergent. These detergents can be made by reacting alkaline earth metal hydroxide or oxide (CaO, $Ca(OH)_2$, BaO, $Ba(OH)_2$, MgO, $Mg(OH)_2$, for example) with an alkyl phenol or sulfurized alkylphenol. Useful alkyl groups include straight chain or branched $C_1$-$C_{30}$ alkyl groups, preferably, $C_4$-$C_{20}$. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

Metal salts of carboxylic acids are also useful as detergents. These carboxylic acid detergents may be prepared by reacting a basic metal compound with at least one carboxylic acid and removing free water from the reaction product. These compounds may be overbased to produce the desired TBN level. Detergents made from salicylic acid are one preferred class of detergents derived from carboxylic acids. Useful salicylates include long chain alkyl salicylates. One useful family of compositions is of the formula

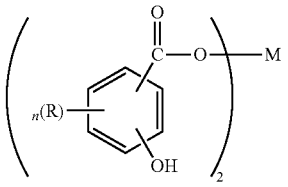

where R is a hydrogen atom or an alkyl group having 1 to about 30 carbon atoms, n is an integer from 1 to 4, and M is an alkaline earth metal. Preferred R groups are alkyl chains of at least $C_{11}$, preferably $C_{13}$ or greater. R may be optionally substituted with substituents that do not interfere with the detergent's function. M is preferably, calcium, magnesium, or barium. More preferably, M is calcium.

Hydrocarbyl-substituted salicylic acids may be prepared from phenols by the Kolbe reaction (see U.S. Pat. No. 3,595,791). The metal salts of the hydrocarbyl-substituted salicylic acids may be prepared by double decomposition of a metal salt in a polar solvent such as water or alcohol.

Alkaline earth metal phosphates are also used as detergents.

Detergents may be simple detergents or what is known as hybrid or complex detergents. The latter detergents can provide the properties of two detergents without the need to blend separate materials. See U.S. Pat. No. 6,034,039 for example.

Preferred detergents include calcium phenates, calcium sulfonates, calcium salicylates, magnesium phenates, magnesium sulfonates, magnesium salicylates and other related components (including borated detergents). Typically, the total detergent concentration is about 0.01 to about 6.0 wt %, preferably, about 0.1 to 0.4 wt %.

Dispersant

During engine operation, oil-insoluble oxidation byproducts are produced. Dispersants help keep these byproducts in solution, thus diminishing their deposition on metal surfaces. Dispersants may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

Chemically, many dispersants may be characterized as phenates, sulfonates, sulfurized phenates, salicylates, naphthenates, stearates, carbamates, thiocarbamates, phosphorus derivatives. A particularly useful class of dispersants are the alkenylsuccinic derivatives, typically produced by the reaction of a long chain substituted alkenyl succinic compound, usually a substituted succinic anhydride, with a polyhydroxy or polyamino compound. The long chain group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471071, to which reference is made for this purpose.

Hydrocarbyl-substituted succinic acid compounds are popular dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between alkenyl succinic anhydrides and amines. Molar ratios can vary depending on the polyamine. For example, the molar ratio of alkenyl succinic anhydride to TEPA can vary from about 1:1 to about 5:1. Representative examples are shown in U.S. Pat. Nos. 3,087,936; 3,172,892; 3,219,666; 3,272,746; 3,322,670; and 3,652,616, 3,948,800; and Canada Pat. No. 1,094,044.

Succinate esters are formed by the condensation reaction between alkenyl succinic anhydrides and alcohols or polyols. Molar ratios can vary depending on the alcohol or polyol used. For example, the condensation product of an alkenyl succinic anhydride and pentaerythritol is a useful dispersant.

Succinate ester amides are formed by condensation reaction between alkenyl succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305.

The molecular weight of the alkenyl succinic anhydrides used in the preceding paragraphs will typically range between 800 and 2,500. The above products can be post-reacted with various reagents such as sulfur, oxygen, formaldehyde, carboxylic acids such as oleic acid, and boron compounds such as borate esters or highly borated dispersants. The dispersants can be borated with from about 0.1 to about 5 moles of boron per mole of dispersant reaction product.

Mannich base dispersants are made from the reaction of alkylphenols, formaldehyde, and amines. See U.S. Pat. No. 4,767,551, which is incorporated herein by reference. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products useful in this invention can be prepared from high molecular weight alkyl-substituted hydroxyaromatics or $HN(R)_2$ group-containing reactants.

Examples of high molecular weight alkyl-substituted hydroxyaromatic compounds are polypropylphenol, polybutylphenol, and other polyalkylphenols. These polyalkylphenols can be obtained by the alkylation, in the presence of an alkylating catalyst, such as $BF_3$, of phenol with high molecular weight polypropylene, polybutylene, and other polyalkylene compounds to give alkyl substituents on the benzene ring of phenol having an average 600-100,000 molecular weight.

Examples of $HN(R)_2$ group-containing reactants are alkylene polyamines, principally polyethylene polyamines. Other representative organic compounds containing at least one $hN(R)_2$ group suitable for use in the preparation of Mannich condensation products are well known and include the mono- and di-amino alkanes and their substituted analogs, e.g., ethylamine and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

Examples of alkylene polyamide reactants include ethylenediamine, diethylene triamine, triethylene tetraamine, tetraethylene pentaamine, pentaethylene hexamine, hexaethylene heptaamine, heptaethylene octaamine, octaethylene nonaamine, nonaethylene decamine, and decaethylene undecamine and mixture of such amines having nitrogen contents corresponding to the alkylene polyamines, in the formula $H_2N\text{-}(Z\text{-}NH\text{—})_nH$, mentioned before, Z is a divalent ethylene and n is 1 to 10 of the foregoing formula. Corresponding propylene polyamines such as propylene diamine and di-, tri-, tetra-, pentapropylene tri-, tetra-, penta- and hexaamines are also suitable reactants. The alkylene polyamines are usually obtained by the reaction of ammonia and dihalo alkanes, such as dichloro alkanes. Thus the alkylene polyamines obtained from the reaction of 2 to 11 moles of ammonia with 1 to 10 moles of dichloroalkanes having 2 to 6 carbon atoms and the chlorines on different carbons are suitable alkylene polyamine reactants.

Aldehyde reactants useful in the preparation of the high molecular products useful in this invention include the aliphatic aldehydes such as formaldehyde (also as paraformaldehyde and formalin), acetaldehyde and aldol (β-hydroxybutyraldehyde). Formaldehyde or a formaldehyde-yielding reactant is preferred.

Hydrocarbyl substituted amine ashless dispersant additives are well known to one skilled in the art; see, for example, U.S. Pat. Nos. 3,275,554; 3,438,757; 3,565,804; 3,755,433, 3,822,209, and 5,084,197.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from about 500 to about 5000 or a mixture of such hydrocarbylene groups. Other preferred dispersants include succinic acid-esters and amides, alkylphenolpolyamine-coupled Mannich adducts, their capped derivatives, and other related components. Such additives may be used in an amount of about 0.1 to 20 wt %, preferably about 0.1 to 8 wt %.

Pour Point Depressants

Conventional pour point depressants (also known as lube oil flow improvers) may be added to the compositions of the present invention if desired. These pour point depressant may be added to lubricating compositions of the present invention to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. No. Nos. 1,815,022; 2,015,748; 2,191,498; 2,387,501; 2,655, 479; 2,666,746; 2,721,877; 2.721,878; and 3,250,715 describe useful pour point depressants and/or the preparation thereof. Such additives may be used in an amount of about 0.01 to 5 wt %, preferably about 0.01 to 1.5 wt %.

Seal Compatilbility Additives

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride. Such additives may be used in an amount of about 0.01 to 3 wt %, preferably about 0.01 to 2 wt %.

Anti-Foam Agents

Anti-foam agents may advantageously be added to lubricant compositions. These agents retard the formation of stable foams. Silicones and organic polymers are typical antifoam agents. For example, polysiloxanes, such as silicon oil or polydimethyl siloxane, provide antifoam properties. Antifoam agents are commercially available and may be used in conventional minor amounts along with other additives such as demulsifiers; usually the amount of these additives combined is less than 1 percent and often less than 0.1 percent.

Friction Modifiers

A friction modifier is any material or materials that can alter the coefficient of friction of a surface lubricated by any lubricant or fluid containing such material(s). Friction modifiers, also known as friction reducers, or lubricity agents or oiliness agents, and other such agents that change the ability of base oils, formulated lubricant compositions, or functional fluids, to modify the coefficient of friction of a lubricated surface may be effectively used in combination with the base oils or lubricant compositions of the present invention if desired. Friction modifiers that lower the coefficient of friction are particularly advantageous in combination with the base oils and lube compositions of this invention. Friction modifiers may include metal-containing compounds or materials as well as ashless compounds or materials, or mixtures thereof. Metal-containing friction modifiers may include metal salts or metal-ligand complexes where the metals may include alkali, alkaline earth, or transition group metals. Such metal-containing friction modifiers may also have low-ash characteristics. Transition metals may include Mo, Sb, Sn, Fe, Cu, Zn, and others. Ligands may include hydrocarbyl derivative of alcohols, polyols, glycerols, partial ester glycerols, thiols, carboxylates, carbamates, thiocarbamates, dithiocarbamates, phosphates, thiophosphates, dithiophosphates, amides, imides, amines, thiazoles, thiadiazoles, dithiazoles, diazoles, triazoles, and other polar molecular functional groups containing effective amounts of O, N, S, or P, individually or in combination. In particular, Mo-containing compounds can be particularly effective such as for example Mo-dithiocarbamates, Mo(DTC), Mo-dithiophosphates, Mo(DTP), Mo-amines, Mo (Am), Mo-alcoholates, Mo-alcohol-amides, etc. See U.S. Pat. Nos. 5,824,627; 6,232,276; 6,153,564; 6,143,701; 6,110,878; 5,837,657; 6,010,987; 5,906,968; 6,734,150; 6,730,638; 6,689,725; 6,569,820; WO 99/66013; WO 99/47629; WO 98/26030.

Ashless friction modifiers may have also include lubricant materials that contain effective amounts of polar groups, for example, hydroxyl-containing hydrocarbyl base oils, glycerides, partial glycerides, glyceride derivatives, and the like. Polar groups in friction modifiers may include hydrocarbyl groups containing effective amounts of O, N, S, or P, individually or in combination. Other friction modifiers that may be particularly effective include, for example, salts (both ash-containing and ashless derivatives) of fatty acids, fatty alcohols, fatty amides, fatty esters, hydroxyl-containing carboxylates, and comparable synthetic long-chain hydrocarbyl acids, alcohols, amides, esters, hydroxy carboxylates, and the like. In some instances fatty organic acids, fatty amines, and sulfurized fatty acids may be used as suitable friction modifiers.

Useful concentrations of friction modifiers may range from about 0.01 wt % to 10-15 wt % or more, often with a preferred range of about 0.1 wt % to 5 wt %. Concentrations of molybdenum-containing materials are often described in terms of Mo metal concentration. Advantageous concentrations of Mo may range from about 10 ppm to 3000 ppm or more, and often with a preferred range of about 20-2000 ppm, and in some instances a more preferred range of about 30-1000 ppm. Friction modifiers of all types may be used alone or in mixtures with the materials of this invention. Often mixtures of two or more friction modifiers, or mixtures of friction modifier(s) with alternate surface active material(s), are also desirable.

Corrosion Inhibitors

Corrosion inhibitors can be described as any materials (additives, functionalized fluids, etc.) that form a protective film on a surface that prevents corrosion agents from reacting or attacking that surface with a resulting loss of surface material. Protective films may be absorbed on the surface or chemically bonded to the surface. Protective films may be constituted from mono-molecular species, oligomeric species, polymeric species, or mixtures thereof. Protective films may derive from the intact corrosion inhibitors, from their combination products, or their degradation products, or mixtures thereof. Surfaces that may benefit from the action of corrosion inhibitors may include metals and their alloys (both ferrous and non-ferrous types) and non-metals. Corrosion inhibitors used to protect metals may also be called metal passivators or metal deactivators. Corrosion inhibitors may include rust inhibitors, which are particularly useful for the protection of ferrous metals and their alloys. Selected corrosion inhibitors may be particularly useful in protecting non-ferrous metals, for example copper and its alloys.

Corrosion inhibitors may include various oxygen-, nitrogen-, sulfur-, and phosphorus-containing materials, and may include metal-containing compounds (salts, organometallics, etc.) and nonmetal-containing or ashless materials. Corrosion inhibitors may include, but are not limited to, additive types such as, for example, hydrocarbyl-, aryl-, alkyl-, arylalkyl-, and alkylaryl-versions of detergents (neutral, overbased), sulfonates, phenates, salicylates, alcoholates, carboxylates, salixarates, phosphites, phosphates, thiophosphates, amines, amine salts, amine phosphoric acid salts, amine sulfonic acid salts, alkoxylated amines, etheramines, polyetheramines, amides, imides, azoles, diazoles, triazoles, benzotriazoles, benzothiazoles, mercaptobenzothiazoles, tolyltriazoles (TTZ-type), heterocyclic amines, heterocyclic sulfides, thiazoles, thiadiazoles, mercaptothiadiazoles, dimercaptothiadiazoles (DMTD-type), imidazoles, benzimidazoles, dithiobenzimidazoles, imidazolines, oxazolines, Mannich reactions products, saligenin derivatives, glycidyl ethers, anhydrides, carbamates, thiocarbamates, dithiocarbamates, polyglycols, etc., or mixtures thereof.

Corrosion agents may derive from many sources, for example from one or more components (additives and/or base stocks) within a finished lubricant composition, from degradation products accumulated in a lubricant fluid during lubricant service, from outside contaminants accumulated in a lubricant fluid during lubricant service, and so forth. Corrosion agents may include, but are not limited to, for example thiols, mercaptans, sulfides, di-, tri-, poly-sulfides, mineral acids, hydrocarbon acids, carboxylic acids, nitrogen-derived acids, sulfur-derived acids, phosphorus-derived acids, oxidized and/or nitrated hydrocarbons, oxidized and/or nitrated lube products, fuel combustion products, lubricating fluid contaminants, oxidized and/or nitrated soots, etc.

Corrosion inhibitors are used to reduce the degradation of metallic parts that are in contact with the lubricating oil composition. Suitable corrosion inhibitors include thiadiazoles. See, for example, U.S. Pat. Nos. 2,179,125; 2,719,126; and 3,087,932. Aromatic triazoles, such as toly triazole, are suitable corrosion inhibitors for non-ferrous metals, such as copper.

Corrosion inhibitor additives may be used in an amount of about 0.001 to 5 wt %, preferably about 0.01 to 1.5 wt %, more preferably about 0.1 5 to 1.0 wt %, still more preferably about 0.2 to 0.6 wt %, even more preferably about 0.2 to 0.5 wt %, most preferably about 0.3 to 0.5 wt % active ingredient, relative to the weight of the total lubricant composition. When the formulations in which the corrosion inhibitor additives are used also contain corrosive anti-wear additives or other corrosive additives, the corrosive additives and corrosion inhibitors are present at a corrosive additive to corrosion inhibitor weight ratio of about 45:1 to 1:1, preferably 30:1 to 1:1, more preferably 15:1 to 1:1, still more preferably about 15:1 to 3:1, even more preferably about 15:2 to 3:1.

Typical Additive Amounts

When lubricating oil compositions contain one or more of the additives discussed above, the additive(s) are blended into the composition in an amount sufficient for it to perform its intended function. Typical amounts of such additives useful in the present invention are shown in Table 1 below.

Note that many of the additives are shipped from the manufacturer and used with a certain amount of base oil solvent in the formulation. Accordingly, the weight amounts in the table below, as well as other amounts mentioned in this specification, are directed to the amount of active ingredient (that is the non-solvent portion of the ingredient). The wt % indicated below are based on the total weight of the lubricating oil composition.

TABLE A

Typical Amounts of Various Lubricant Oil Components

| Compound | Approximate wt % (Useful) | Approximate wt % (Preferred) |
|---|---|---|
| Detergent | 0.01-6 | 0.01-4 |
| Dispersant | 0.1-20 | 0.1-8 |
| Friction Reducer | 0.01-5 | 0.01-1.5 |
| Viscosity Index Improver | 0.0-40 | 0.01-30, more preferably 0.01-15 |
| Antioxidant | 0.1-5 | 0.1-1.5 |
| Anti-wear Additive | 0.01-6 | 0.01-4 |
| Pour Point Depressant | 0.0-5 | 0.01-1.5 |
| Anti-foam Agent | 0.001-3 | 0.001-0.15 |
| Base stock or base oil | Balance | Balance |

In the present specification, kinematic viscosity (KV) refers to a measurement made by ASTM method D445; air release refers to a measurement made by ASTM D 3427 test method at 50° C.

EXAMPLE 1

A GTL-6 base stock (KV @100° C. of 6.05 $mm^2/s$) was evaluated for air release. The base stock air release rate was measured for the base stock itself and when addilized with 10 wt % and 50 wt % each of Esterex A32 (di-isooctyl adipate) KV at 100° C. of 2.73 $mm^2/s$ or alkylated naphthalene individually. Reference to Table 1 shows that whereas the alkylated naphthalene increased the air release time (i.e., decreased the air release rate) the use of the Esterex A32 decreased the air release time (i.e. increased the air release rate).

TABLE 1

| Components | | | | | |
|---|---|---|---|---|---|
| GTL 6 | 100.0 | 90.0 | 90.0 | 50.0 | 50.0 |
| Alkylated Naphthalene | 0 | 0 | 10.0 | 0 | 50.0 |
| Esterex A32 | 0 | 10.0 | 0 | 50.0 | 0 |
| Air Release @50° C. | | | | | |
| Time to 0.2% Air, mins | 1.54 | 1.00 | 1.55 | 0.82 | 1.74 |
| % change in air release rate | | +35 | — | +47 | −13 |

EXAMPLE 2

This example compares the air release rate for GTL-6 base stock versus 2 different Group III base stocks. Base stock Group IIIA is an isomerized stock wax while base stock Group IIIB is a hydroprocessed mineral oil. Both meet API Group III specifications. All base stocks have a kinematic viscosity of about 6 $mm^2/s$ at 100° C. The air release rate of each stock was measured first for each base stock per se, then redetermined for each base stock mixed with Esterex A32. Reference to Table 2 shows that whereas for the GTL-6 base stock the addition of the Esterex A32 increased the air release rate by 35%, the addition of the Esterex A32 to the Group III (A) base stock actually reduced the air release rate while the addition of the Esterex A32 to the Group III (B) base stock improved the air release rate by only 10%.

TABLE 2

| | GTL | GTL | Gr III (A) | Gr III (A) | Gr III (B) | Gr III (B) |
|---|---|---|---|---|---|---|
| Base Stock | 100 | 90 | 100 | 90 | 100 | 90 |
| Kinematic Viscosity at 100° C. $mm^2/s$ | 6.05 | 6.05 | 6.59 | 6.51 | 6.50 | 6.50 |
| Esterex A32 | 0 | 10 | 0 | 10 | 0 | 10 |
| Time to 0.2% Air, mins | 1.54 | 1.00 | 1.59 | 1.62 | 1.90 | 1.70 |
| % change in air release rate | | +35 | | −2 | | +10 |

EXAMPLE 3

The example presents the discovery that the addition of Esterex A51 to a GTL-4 base oil (KV @100° C. of 3.6 $mm^2/s$), as taught in U.S. Pat. No. 6,627,779 teaches away from the present invention because the addition of the Esterex A51 (di-tridecyladipate, KV at 100° C. of 5 $mm^2/s$) to the GTL-4 base oil results in a decrease in the air release rate whereas the addition of the same amount of Esterex A51 to a GTL-6 base stock results in an increase in the air release rate. See Table 3.

TABLE 3

| | | | | |
|---|---|---|---|---|
| GTL 4 | 100 | 95.0 | 0 | 0 |
| GTL 6 | 0 | 0 | 100 | 95.0 |
| Esterex A51 | 0 | 5.0 | 0 | 5.0 |
| Time to 0.2% Air, Mins | 0.42 | 0.54 | 1.54 | 1.00 |
| % increase in air release rate | | −30 | | +35 |

EXAMPLE 4

This example demonstrates the air-release rate change obtained by using a trimethylolpropane ester of mixed $C_8$-$C_{10}$ acids (TMP Ester $C_8$-$C_{10}$, KV at 100° C of 4.3 $mm^2/s$), a polyol ester, compared with the air release rate change obtained using Esterex A32 in a GTL-6 base oil. As seen in Table 4, while both esters increase the air release rate of the GTL-6 base oil, the TMP Ester $C_8$-$C_{10}$ increases the air release rate to a significantly higher degree.

TABLE 4

| | | | |
|---|---|---|---|
| GTL 6 | 100 | 90.0 | 90.0 |
| Esterex A32 | 0 | 10.0 | 0 |
| TMP Ester $C_8$-$C_{10}$ | 0 | 0 | 10.0 |
| Time to 0.2% Air, mins | 1.54 | 1.00 | 0.11 |
| % increase in air release rate | | +35 | +92.5 |

EXAMPLE 5

This example demonstrates the air release rate change obtained by using a monocarboxylic acid ester compared with the air release rate change obtained using Esterex A51 (di-tridecyl adipate, a di ester). The mono carboxylic acid tested was ethyl hexyl stearate, available commercially from Sea-Land Chemical under the name Stantex® EHS (KV @30° C. of 13 $mm^2/s$).

Reference to Table 5 shows that while both esters increase the air release rate of the GTL 6 base oil, the monocarboxylic acid ester increases the air release rate to a significantly higher degree.

TABLE 5

| | | | |
|---|---|---|---|
| GTL 6 | 100 | 95.0 | 95.0 |
| Esterex A51 | 0 | 5.0 | 0 |
| Stantex EHS | 0 | 0 | 5.0 |
| Time to 0.2% Air, mins | 1.54 | 1.00 | 0.00 |
| % increase in air release rate | | +35 | +92.5 |

What is claimed is:

1. A method for improving the air release rate of lubricating oils comprising a Gas-to-Liquids (GTL) base stock or base oil which GTL base stock or base oil has a kinematic viscosity at 100° C. of at least 6 $mm^2/s$ ±0.4 $mm^2/s$ by combining into the lubricating oil a mono-, di- or tri ester or a polyol ester in an amount of at least 0.5 wt %, wherein the air release rate of the lubricating oil comprising GTL base stock or base oil is improved compared to the air release rate of a lubricating oil containing the GTL base stock or base oil without the ester.

2. The method of claim 1 wherein he GTL base stock and/or base oil component of the lubricating oil has a kinematic viscosity at 100° C. of at least 6 $mm^2/s$ ±0.2 $mm^2/s$.

3. The method of claim 1 wherein the GTL base stock and/or base oil component of the lubricating oil has a kinematic viscosity at 100° C. of at least 8 $mm^2/s$ ±0.5 $mm^2/s$.

4. The method of claim 1 wherein the GTL base stock and/or base oil is hydrodewaxed or hydroisomerized/catalytic (and/or solvent) dewaxed waxy synthetic hydrocarbons.

5. The method of claim 4 wherein the waxy synthetic hydrocarbons are Fischer-Tropsch hydrocarbons.

6. The method of claim 1, 2, 3, 4 or 5 wherein the ester is one or more mono-ester, or polyol ester or mixtures thereof, wherein said polyol ester(s) is/are obtained by reacting one or more neopentyl polyols with one or more linear and/or branched alkanoic acids containing at least 4 carbon atoms.

7. The method of claim 6 wherein the ester is one or more mono-ester of a mono-carboxylic acid reacted with a mono alcohol.

8. The method of claim 6 wherein the ester is one or more polyol esters obtained by reacting one or more neopentyl alcohols selected from the group consisting of neopentyl glycol, trimethylolethane, trimethylol propane, 2-methyl-2 propyl-1,3 propane diol, pentaerythritol, dipentaerythritol and mixtures thereof with one or more alkanolic acids containing from 5 to 30 carbon atoms.

9. The method of claim 6 wherein the ester has a kinematic viscosity at 100° C. of at least 1.5 $mm^2/s$.

10. The method of claim 7 wherein the ester has a kinematic viscosity at 100° C. of at least 1.5 $mm^2/s$.

11. The method of claim 8 wherein the ester has a kinematic viscosity at 100° C. of at least 1.5 $mm^2/s$.

12. The method of claim 6 wherein the ester is selected from the group consisting of di-isooctyl adipate, di-tridecyl adipate, TMP Ester $C_8$-$C_{10}$, and ethylhexyl stearate.

13. The method of claim 6 wherein the ester is ethylhexyl stearate, TMP Ester $C_8$-$C_{10}$ or mixture thereof.

14. A method for improving the air release rate of Gas-to-Liquids (GTL) base stock and/or base oil having a kinematic viscosity at 100° C. of 6 $mm^2/s$ ±0.4 $mm^2/s$ by combining into the GTL base stock and/or base oil at least 0.5 wt % of one or more mono-, di- or tri ester, or polyol ester wherein the air release rate of the GTL base stock and/or base oil is improved as compared to the air release rate of the GTL base stock and/or base oil without the ester.

15. The method of claim 14 wherein the GTL base stock and/or base oil is hydrodewaxed or hydroisomerized/catalytic (and/or solvent) dewaxed waxy synthetic hydrocarbons.

16. The method of claim 15 wherein the waxy synthetic hydrocarbons are Fischer-Tropsch hydrocarbons.

17. The method of claim 14, 15 or 16 wherein the GTL base stock and/or base oil has a kinematic viscosity at 100° C. of at least 6 $mm^2/s$ ±0.2 $mm^2/S$.

18. The method of claim 14, 15 or 16 wherein the ester is one or more mono ester, polyol ester or mixture thereof, wherein the polyol ester(s) is/are obtained by reacting one or more neopentyl polyols with one or more linear and/or branched alkanoic acids containing at least 4 carbon atoms.

19. The method of claim 14, 15 or 16 wherein the ester is one or more mono-ester of a mono-carboxylic acid reacted with a monoalkanol.

20. The method of claim 18 wherein the ester is one or more polyol ester obtained by reacting one or more neopentyl alcohols selected from the group consisting of neopentyl glycol, trimethylolpropane, trimethylol ethane, 2-methyl-2-propyl-1,3 propanediol, pentaerythritol, dipentaerythritol and mixtures thereof with one or more alkanoic acids containing from 5 to 30 carbon atoms.

21. The method of claim 18 wherein the ester is selected from the group consisting of di-isooctyl adipate, di-tridecyl adipate, ethylhexyl stearate, TMP Ester $C_8$-$C_{10}$ and mixtures thereof.

22. The method of claim 21 wherein the ester is ethyl hexyl stearate, TMP Ester $C_8$-$C_{10}$ or mixture thereof.

23. The method of claim 1 wherein the air release rate is improved by at least about 35% compared to the air release rate of the lubricating oil without the ester.

24. The method of claim 14 wherein the air release rate is improved by at least about 35% compared to the air release rate of the GTL base stock and/or base oil without the ester.

25. A lubricating oil comprising a Gas-to-Liquids (GTL) base stock and/or base oil, said GTL base stock and/or base oil having a kinematic viscosity at 100° C. of at least 6 $mm^2/s$ ±0.4 $mm^2/s$ and a mono-, di- or tri-ester or polyol ester in an amount of at least 0.5 wt %, the lubricating oil having an air release rate at least 35% higher than a lubricating oil comprising the GTL base stock and/or base oil having a kinematic viscosity at 100° C. of at least 6 $mm^2/s$ +0.4 $mm^2/s$ but which does not contain an ester.

26. A GTL base stock and/or base oil of improved air release rate comprising a GTL base stock and/or base oil having a kinematic viscosity at 100° C. of at least 6 $mm^2/s$ ±0.4 $mm^2/s$ and a mono- di- or tri- ester or polyol ester in an amount of at least 0.5 wt %, the GTL base stock and/or base oil having an air release rate at least 35% higher than GTL base stock and/or base oil having a kinematic viscosity at 100° C. of at least 6 $mm^2/s$ +0.4 $mm^2/s$ but which does not contain an ester.

27. The lubricating oil of claim 25 wherein the GTL base stock and/or base oil is hydrodewaxed or hydroisomerized/catalytic (and/or solvent) dewaxed Fischer-Tropsch hydrocarbon, and the ester is selected from the group consisting of di_isooctyl adipate, di-tridecyl adipate, ethyl hexyl stearate, TMP Ester $C_8$-$C_{10}$ or mixture thereof.

28. The GTL base stock and/or base oil of claim 26 wherein the GTL base stock and/or base oil is hydrodewaxed or hydroisomerized/catalytic (and/or solvent) dewaxed Fischer-Tropsch hydrocarbons and the ester is selected from the group consisting of di-isooctyl adipate, di-tridecyladipate, ethylhexyl stearate, TMP Ester $C_8$-$C_{10}$ or mixture thereof.

* * * * *